US007345412B2

(12) United States Patent
Arndt et al.

(10) Patent No.: US 7,345,412 B2
(45) Date of Patent: Mar. 18, 2008

(54) HIGH PRESSURE ELECTRIC LAMP HAVING A BASE AT ONE END

(75) Inventors: Joachim Arndt, Brieselang (DE); Uwe Fidler, Berlin (DE); Markus Herb, Gunzburg (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 365 days.

(21) Appl. No.: 11/185,938

(22) Filed: Jul. 21, 2005

(65) Prior Publication Data

US 2006/0028113 A1 Feb. 9, 2006

(30) Foreign Application Priority Data

Aug. 5, 2004 (DE) ..... 20 2004 012 293 U

(51) Int. Cl.
*H01J 5/48* (2006.01)

(52) U.S. Cl. ..... 313/318.01; 313/318.05; 313/318.08

(58) Field of Classification Search ..... None
See application file for complete search history.

(56) References Cited

U.S. PATENT DOCUMENTS 5,627,428 A * 5/1997 Helbig et al. ..... 313/318.01
6,031,323 A * 2/2000 Behr et al. ..... 313/318.01

FOREIGN PATENT DOCUMENTS

| | | |
|---|---|---|
| DE | 43 17 252 | 5/1994 |
| DE | 19856871 | 6/2000 |
| EP | 1 109 199 | 12/2000 |

* cited by examiner

*Primary Examiner*—Ashok Patel
(74) *Attorney, Agent, or Firm*—William E. Meyer

(57) ABSTRACT

An electric lamp having a base at one end, a lamp bulb sealed in a vacuum-tight manner, the lamp bulb being surrounded by an envelope part, a base having electrical connections bearing on one side the outer bulb and on the other side the envelope part, having the following features:
a) the base has a base insulator which has a central opening in which the outer bulb is accommodated without cement;
b) the base insulator has a circular, radially projecting segment having an upper and lower plateau which is associated with the base;
c) on the base side the envelope part has a circular opening having a radially projecting edge which has a lower and an upper contact surface in relation to the base, the lower contact surface matching the upper plateau; and
d) the envelope part is fixed to the base via a cement-free, mechanical retaining mechanism.

9 Claims, 5 Drawing Sheets

HIGH PRESSURE ELECTRIC LAMP HAVING A BASE AT ONE END

TECHNICAL FIELD

The invention relates to a lamp having a base at one end, in particular a high-pressure lamp, having a lamp bulb which is sealed in a vacuum-tight manner, said lamp bulb being surrounded by an envelope part, a base having electrical connections bearing on one side the lamp bulb and on the other side the envelope part. Of particular concern here are high-pressure discharge lamps, preferably metal halide lamps, or else, for example, halogen incandescent lamps. In this case, an elongate, in particular ceramic discharge vessel is often used as the lamp bulb.

BACKGROUND ART

U.S. Pat. No. 5,576,591 has already disclosed a lamp having a base at one end, which comprises three bulbs. It has a ceramic adapter which is mounted on a screw base. Atmospheric pressure prevails between the envelope bulb and the outer bulb.

U.S. Pat. No. 6,411,036 discloses a high-pressure lamp having a base at one end, in the case of which the outer bulb is surrounded by a reflector. The base is fixed directly to the reflector neck by means of crimping. One disadvantage of this is the fact that the dimensions of the neck of the reflector must be matched to the standard dimensions of the base.

DISCLOSURE OF THE INVENTION

It is the object of the present invention to provide a lamp having a base at one end in in particular a high-pressure lamp, having a lamp bulb which is sealed in a vacuum-tight manner, said lamp bulb being surrounded by an envelope part, a base having electrical connections bearing on one side the lamp bulb and on the other side the envelope part, which lamp can be mounted easily and can be produced in a manner which can easily be automated.

This object is achieved by the following features:

a) the base has a base insulator which is produced from an insulating material and has a central opening in which the lamp bulb is accommodated without cement;

b) the base insulator has a circular, radially projecting segment having an upper plateau which is associated with the base;

c) on the base side the envelope part has a circular opening which rests on the upper plateau of the circular, radially projecting segment; and d) the envelope part is fixed to the base by means of cement, for which purpose the base insulator has a platform having a side wall in which at least one cut-out pocket is introduced. Particularly advantageous refinements are described in the dependent claims.

The lamp having a base at one end according to the invention has a lamp bulb which is sealed in a vacuum-tight manner, in particular an elongate discharge vessel, which is possibly also accommodated in an outer bulb, the lamp bulb, i.e. the discharge vessel or else the modular unit comprising the discharge vessel and the outer bulb, also being surrounded by an envelope part. The lamp bulb is preferably a ceramic discharge vessel, in particular for a metal halide lamp, for example, for general lighting purposes. In this case, a base having electrical connections bears on one side the lamp bulb and on the other side the envelope part. The electrical connections are normally connected to power supply lines which produce an electrical contact with a luminous means in the interior of the lamp bulb, for example, the luminous means is implemented by electrodes or a luminous element of an incandescent lamp. Without restricting the invention, outer electrodes may also be used, or else an electrode-free design. In place of a ceramic discharge vessel, a discharge vessel made of quartz glass or hard glass may also be used. An outer bulb is not absolutely necessary.

According to the invention, the combination of the following features is used, which means that laborious frame mounting and hot processes such as fusing and baking of the base cement can be dispensed with:

a) the base has a base insulator which is produced from an insulating material and has a central opening in which the lamp bulb is accommodated using cement or else without cement;

b) the base insulator has a radially projecting segment, which is, in particular, circular, having an upper plateau which is associated with the base, and possibly also a lower plateau;

c) on the base side the envelope part has an, in particular circular, opening having a contact surface which rests on the upper plateau of the radially projecting segment on the base insulator; and d) the envelope part is fixed to the base by means of cement, which is introduced between an upper stepped wall and the envelope part in the vicinity of the opening in said envelope part, the upper stepped wall being provided with at least one pocket which can accommodate some of the cement when it swells up.

In the context of the invention, the pockets are implemented by individual cutouts or facets on the base, or alternatively by one or more circumferential grooves.

In addition to the base insulator, the base has a conventional part which faces the socket, for example a screw base attachment or a bayonet-type base attachment.

The lamp bulb, i.e., for example, the outer bulb or the discharge vessel in the case of the absence of an outer bulb, is preferably retained in the central opening by means of a spring clip. This technique is in principle known per se, cf. for example U.S. Pat. No. 6,469,428.

In particular, the edge of the envelope part and the base insulator are equipped with an interacting anti-rotation mechanism.

A simple and reliable solution which is easy to produce to the design for the pockets is a stepped wall which is in the form of a polygon based on the usual circular ring which it represents in section. The individual facets of the polygon are concave surfaces. A preferred design in which the volume of the pocket can be controlled more easily and which has a better optical effect is a two-part wall, in the case of which a larger, lower part (approximately 60 to 80% of the height of the stepped wall) comprises the facets, and the remaining height is beveled inwards.

The increase in surface area is preferably 20 to 70%, in relation to the original adhesion surface of the annular stepped wall, the area of which is now increased by the facets. The facets increase the area of the adhesion surface of the cement and at the same time provide room for swelling of the cement. The volume of the facets is therefore also a variable which is worth considering. In the simplest case, it is determined by the greatest depth of the facet, and secondly by the shape of the curve.

This variable depends on the cement used. Depending on its ability to swell, the depth of the facet should be matched to the cement.

The base also usually has a part which faces the lampholder and, as known per se, is connected to the base insulator at least partially by means of crimping. This part contains, for example, a conventional screw thread.

The envelope part may be, for example, a closed part such as a further outer bulb, which is not, however, sealed in a vacuum-tight manner, or else a dome which has a reflector contour.

A typical application is a halogen incandescent lamp or a metal halide lamp which contains a filling with or without a mercury content, possibly having an inert starting gas, advantageously a noble gas.

BRIEF DESCRIPTION OF THE DRAWINGS

The invention will be explained in more detail below with reference to a plurality of exemplary embodiments. In the drawings.

BEST MODE FOR CARRYING OUT THE INVENTION

Figure 1:
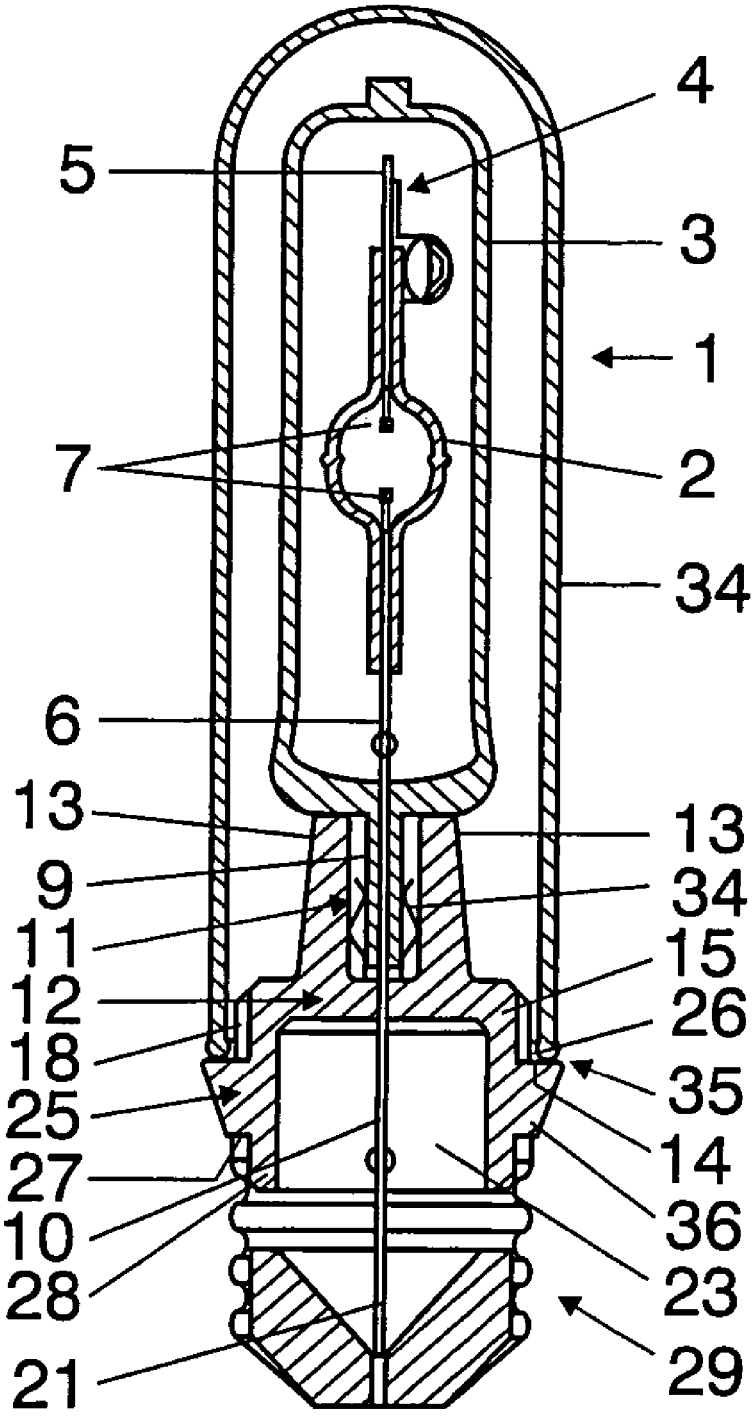
FIG. 1 shows a side view, in section, of a metal halide lamp.

FIG. 1 shows an exemplary embodiment of a metal halide lamp 1. A ceramic discharge vessel 2 which is sealed at two ends is arranged, elongate, on the lamp axis. It is tightly surrounded by an outer bulb 3 which is pinch-sealed at one end and is produced from hard glass. A frame 4 having a short and a long feed line 5, 6 (which can only be seen partially in section) retains the discharge vessel 2 in the outer bulb 3. The electrodes 7 in the interior of the discharge vessel are connected to the feed lines 5, 6. The latter are connected to outer power supply lines 10 (only partially visible) in the region of a pinch seal 9 which seals the outer bulb 3. The pinch seal 9 of the outer bulb rests in an opening 11 which is suitable for this purpose in a base insulator 12 made of ceramic or plastic and is retained there by a metal clip 34. This opening 11 is formed by two walls 13 or else is cut away in a central, circumferential collar part.

The walls 13 rest on a platform 15 which is in principle of cylindrical design having a side wall. The side wall of the platform, however, is not smooth, i.e. a circular ring, but is split into two sections. The lower section 16 forms the actual circular ring which comprises approximately 80% of the height of the platform. The upper section 17 is beveled inwards, to be precise preferably straight or with a convex curvature.

A critical feature is the pockets 18 in the side wall which are in the form of continuous concave facets in the lower section 16. For example, eight facets are distributed evenly over the periphery of the circle of the lower section.

The platform 15 protrudes from a plane which forms the upper plateau 14 of a radially projecting, disk-shaped segment 25. The segment 25 is furthermore designed to have a beveled side wall 36 and a lower plateau 27. It rests on a neck part 28 which retains a part which faces the lampholder, in this case a screw base part 29 having a thread. The screw base 29 is fixed on the neck part 28 by means of crimping. The neck part 28 is hollow inside, the power supply lines 10 being connected to electrical connections 21 (only one is shown) of the base in the cavity 23 of the neck part.

An envelope bulb 34, which surrounds the outer bulb 3 at a relatively great distance, has a base-side opening 35 which is circular-cylindrical and is matched loosely in terms of diameter to the outer diameter of the platform 15. Cement 26 is introduced between the two parts which are matched to one another in terms of shape and dimensions, said cement 26 being applied to the plateau 14 in the region of the opening 35 in the envelope bulb and the first section 16 and swelling, preferably into the facets 18, on baking. As an alternative, it is only introduced into the facets or pockets, the envelope part bearing tightly against the side wall.

Figure 2:
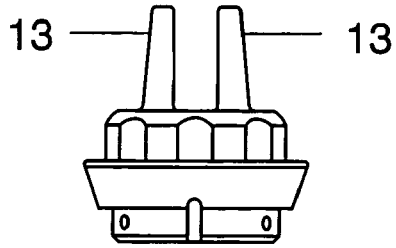
FIGS. 2 and 3 show a side view and a side view rotated through 90° of the base insulator of the lamp shown in FIG. 1.
Figure 3:
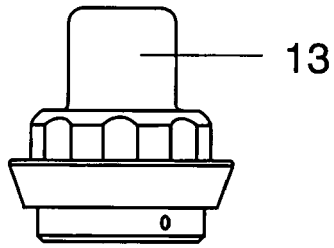

FIGS. 2 and 3 show the base insulator in two side views rotated through 90°.

Figure 4:
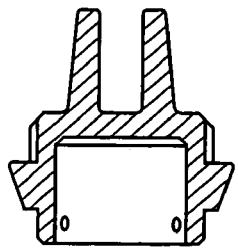
FIGS. 4 and 5 show a side view, in section, and a plan view of the base insulator of the lamp shown in FIG. 1.
Figure 5:
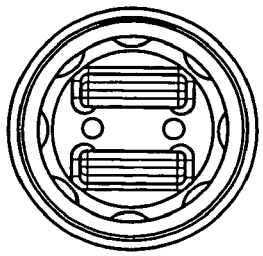

FIG. 4 shows a cross section through the base insulator. FIG. 5 shows a view from above.

Figure 6:
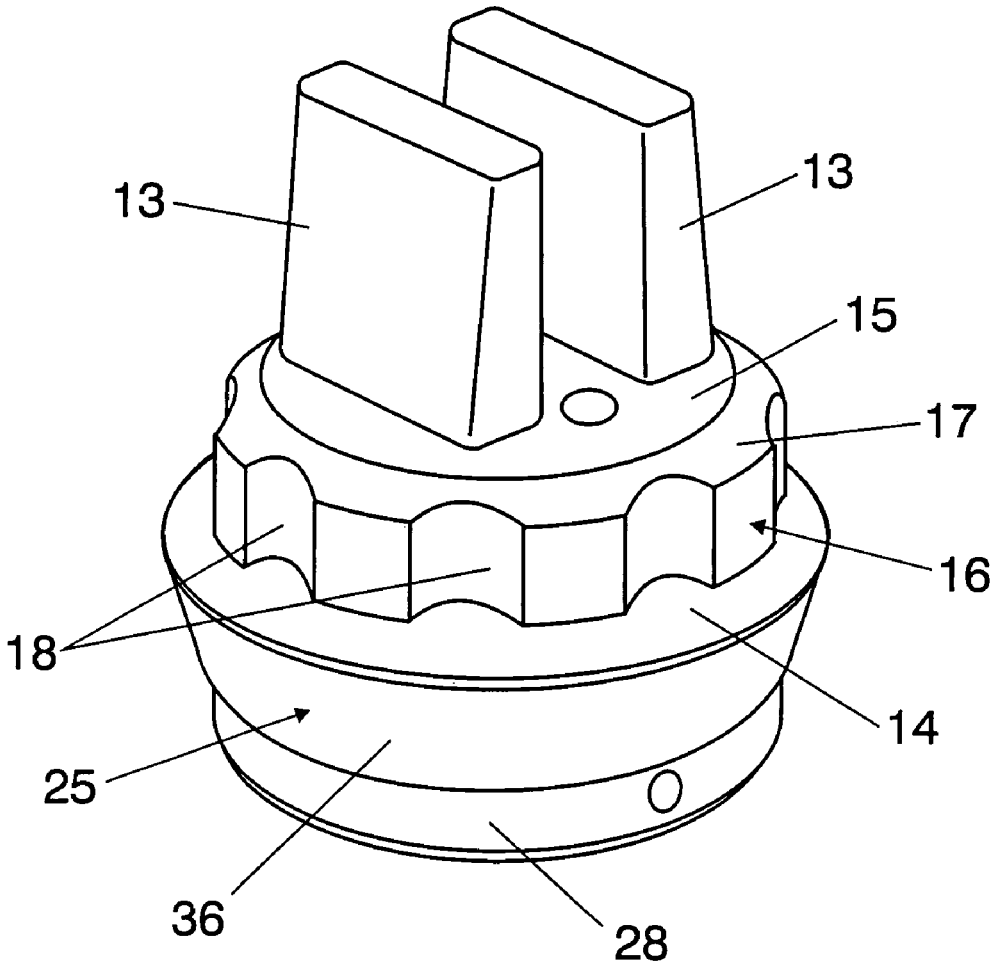
FIG. 6 shows a perspective side view of the base insulator of the lamp shown in FIG. 1.

Finally, FIG. 6 shows a perspective view.

Figure 7:
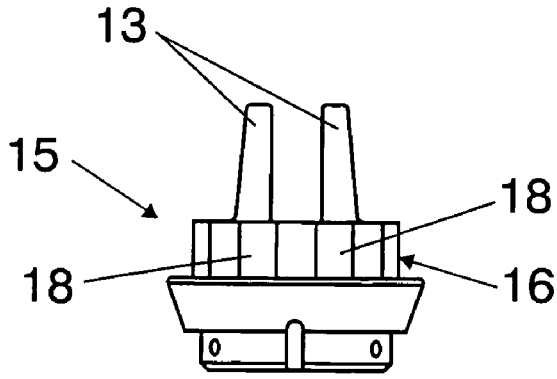
FIGS. 7 to 12 show various embodiments of the base insulator.

FIG. 7 shows a second exemplary embodiment of a base insulator, in the case of which the side wall 16 of the platform 15 is overall in the form of a circular cylinder. The concave facets 18 extend over the entire height of the side wall.

Figure 8:
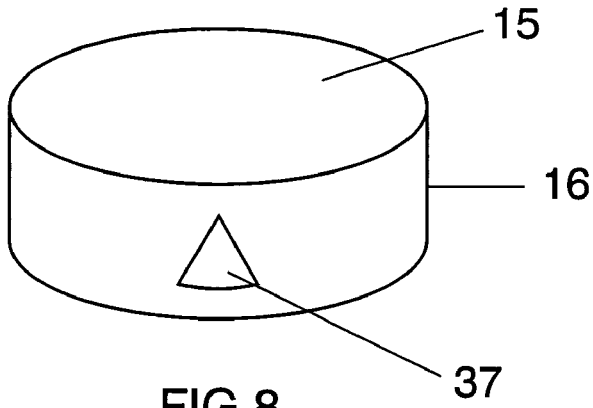
Figure 9:
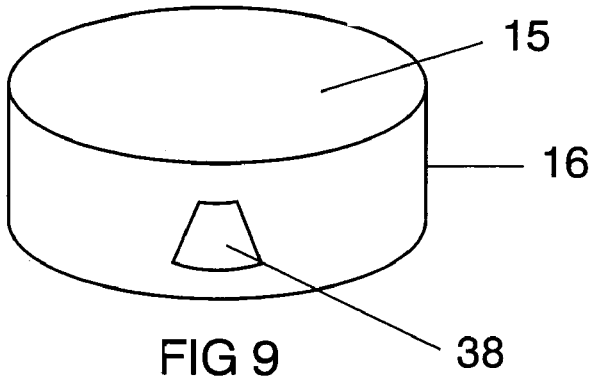
Figure 10:
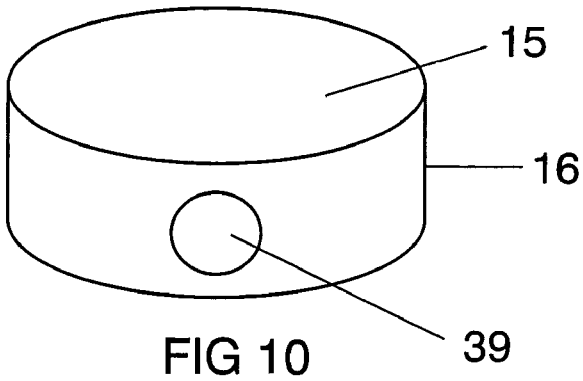

FIG. 8 shows a further exemplary embodiment, in the case of which the facets on the side wall 16 of the platform 15 are in the form of triangles 37. In FIG. 9, they are in the form of trapezoids 38, and in FIG. 10, for the case of a cement which swells only slightly, they are in the form of semicircular domes 39 which are cut out in the side wall.

To give an idea of the dimensions, the diameter of the circular ring of the side wall should be estimated at approximately 25 mm. The total surface area of the side wall is typically 78 $mm^2$. A typical surface area for a facet is 3 to 4 $mm^2$. A typical number of facets is 6 to 10. In the case of eight facets, a specific exemplary embodiment has an increase in surface area of approximately 35%.

One exemplary embodiment is a reflector lamp as known per se, the envelope part having the contour of a reflector which is typically produced from aluminum.

Figure 11:
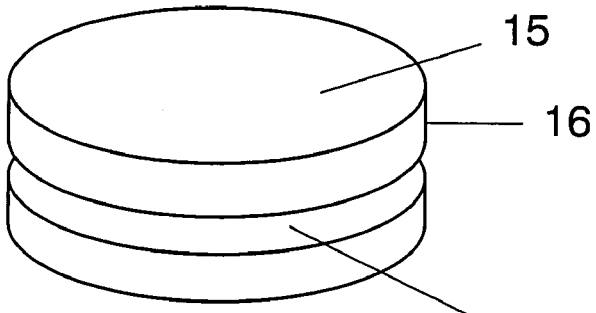

Another alternative is shown in FIG. 11. Here, the pocket is implemented in the form of a circumferential channel 40 in the side wall 16 of the platform 15.

Incidentally, the cement may either be accommodated exclusively in the pocket(s) or alternatively distributed over the entire side wall and principally only collected in the pockets.

Figure 12:
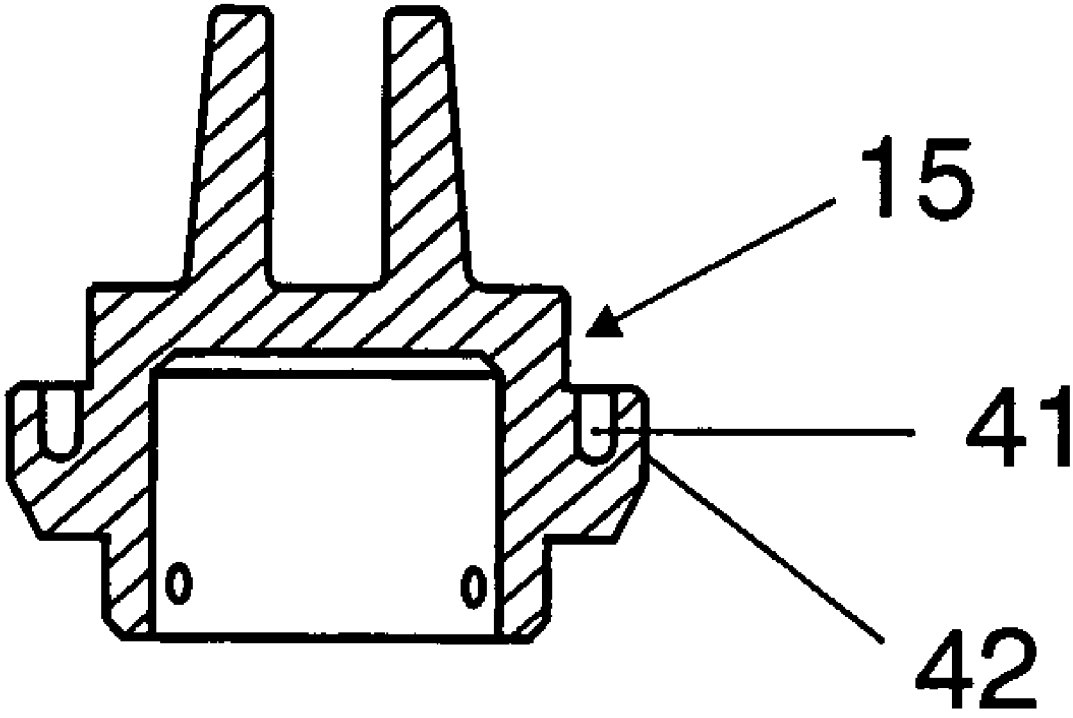

A further alternative is shown in FIG. 12. Here, the pocket is implemented in the form of a circumferential channel 41 in the side wall 16 of the platform 15 such that the channel is implemented in the extension of the side wall and with a circumferential flange edge 42.

In cross section, the depression may have a uniform concave curvature, for example as a facet, or may be U-shaped, trough-shaped or V-shaped in section.

What is claimed is:

1. An electric high pressure lamp having a base at one end comprising: a lamp bulb which is sealed in a vacuum-tight manner, said lamp bulb being surrounded by an envelope part, a base having on one side of the base, electrical connections that bear on the lamp bulb and another other side of the base, the base bears on the envelope part, characterized by the combination of the following features:

a) the base has a base insulator which is produced from an insulating material and has a central opening in which the lamp bulb is accommodated without cement;

b) the base insulator has a circular, radially projecting segment having an upper plateau which is associated with the base;

c) on the base side the envelope part has a circular opening which rests on the upper plateau of the circular, radially projecting segment; and d) the envelope part is fixed to the base by means of cement, for which purpose the base insulator has a platform having a side wall in which at least one cut-out pocket is introduced.

2. The electric lamp as claimed in claim 1, characterized in that a plurality of pockets are concave facets.

3. The electric lamp as claimed in claim 1, characterized in that a single pocket is in the form of a groove running around the side wall.

4. The electric lamp as claimed in claim 3, characterized in that a single pocket is in the form of a groove which runs around the extension of the side wall and has a dedicated circumferential flange edge.

5. The electric lamp as claimed in claim 1, characterized in that the side wall is split into two sections, the pockets being fitted in the lower section.

6. The electric lamp as claimed in claim 1, characterized in that a plurality of pockets are triangular or trapezoidal or in the form of domes.

7. The lamp as claimed in claim 1, characterized in that the base has a part which faces the lampholder and is connected to the base insulator at least partially by means of crimping.

8. The lamp as claimed in claim 1, characterized in that the envelope part is a closed bulb or has a reflector contour.

9. The lamp as claimed in claim 1, characterized in that the envelope part is produced from glass or aluminum.

* * * * *